US006122779A

United States Patent [19]

Meili et al.

[11] Patent Number: 6,122,779

[45] Date of Patent: Sep. 26, 2000

[54] BED BASE

[75] Inventors: Peter Meili, CH-5615 Fahrwangen, Fahrwangen; Adolf Pfister, Gränichen, both of Switzerland

[73] Assignee: Peter Meili, Fahrwangen, Sweden

[21] Appl. No.: 09/424,411

[22] PCT Filed: Apr. 28, 1998

[86] PCT No.: PCT/CH98/00171

§ 371 Date: Nov. 22, 1999

§ 102(e) Date: Nov. 22, 1999

[87] PCT Pub. No.: WO98/52442

PCT Pub. Date: Nov. 26, 1998

[30] Foreign Application Priority Data

May 20, 1997 [CH] Switzerland ..... 1165/97
May 30, 1997 [CH] Switzerland ..... 1287/97

[51] Int. Cl.[7] ..... A47C 23/06

[52] U.S. Cl. ..... 5/236.1; 5/238

[58] Field of Search ..... 5/236.1, 237, 238

[56] References Cited

FOREIGN PATENT DOCUMENTS

| | | |
|---|---|---|
| 904 107 | 5/1986 | Belgium . |
| 031 132 | 7/1981 | European Pat. Off. . |
| 116 237 | 8/1984 | European Pat. Off. . |
| 150 873 | 8/1985 | European Pat. Off. . |
| 243 383 | 12/1990 | European Pat. Off. . |
| 27 09 919 | 9/1978 | Germany . |
| 39 33 816 | 4/1991 | Germany . |
| 66 708 | 3/1973 | Luxembourg . |

*Primary Examiner*—Alexander Grosz
*Attorney, Agent, or Firm*—Pauley Petersen Kinne & Fejer

[57] ABSTRACT

A base of a bed having two parallel elastic longitudinal bars arranged at a distance from each other, and several grate-shaped cross slats. The ends of the cross slats are pushed into pockets which are fitted on the longitudinal bars, perpendicularly to the longitudinal direction. Each longitudinal bar has at least one fastening band which is fastened perpendicularly to the longitudinal direction and in the direction of the other longitudinal bar. The neighboring cross slat has a button for attaching the fastening band to the cross slat. This structure guarantees stable and non-aging fastening of the cross slats to the longitudinal bars with minimal means and the structure is also easy to assemble.

10 Claims, 2 Drawing Sheets

BED BASE

BACKGROUND OF THE INVENTION

1. Field of the Invention

This invention relates to a support for a bed having parallel longitudinal rails, transverse slats and pockets.

2. Description of Prior Art

For resting comfortably in bed in any position, a bed device must exercise a support function which can adapt itself to every situation. Conventional beds therefore have a grate of slats with raised resilient transverse slats. Furthermore, with conventional beds, the construction of the mattress placed on this slat grate is specially designed.

Moreover, so-called natural beds are known, which have an optimum support effect in spite of the use of very thin mattresses or futons. Here, the slat grate of conventional beds is replaced by a plurality of transverse slats made of solid wood, which rest on longitudinal rails, and which are resilient vertically with respect to their loading and therefore act as spring bodies.

Thus, European Patent Reference EP-A-0 116 237 discloses a bed device, which has two inflatable longitudinal rails arranged parallel with each other, in which a series of pockets is arranged tangentially and transversely with respect to the longitudinal direction. Transverse slats are pushed into these pockets, of which one end is supported in one of the longitudinal rails and the other end in the other longitudinal rail. A grate is created which has increased flexibility. Fixing the transverse slats in relation to the longitudinal rails is controlled by the lateral walls of the bed frame, if this support is placed in such a frame. In another variation, a yoke-like structure is provided, through which the longitudinal rails extend and by means of which the two longitudinal rails are braced against each other. A transverse slat is also inserted into this yoke-like structure in order to assure stability. The assembly of this bracing is relatively complicated and can therefore often not be performed by the buyer. But the variation without bracing is unstable and unsuitable if, for example, the bed support must be displaced in the course of housecleaning, or removed for some other purpose.

European Patent Reference EP-A-0 243 383 also describes a natural bed with two resilient longitudinal rails made of a foam material or of foam rubber, and a plurality of transverse slats arranged grate-like above them. The transverse slats are connected with each other with a cloth over the entire surface, which simultaneously fixes the longitudinal rails in place. For this purpose the cloth has pockets at two oppositely located longitudinal edges, which are oriented transversely to the longitudinal direction and in which the ends of the transverse slats are held. In one variation the longitudinal rails are arranged between the cloth which acts as the covering, in another variation tunnel-like webs are fastened on the cloth, into which the longitudinal rails are pushed. Although this structure assures satisfactory stability, it has several disadvantages. For one, the cloth acts as a dust collector. Then, the airing of the bed from below is hampered and the tension in the cloth relaxes over time and during use and thus diminishes the stability.

A similar construction of a bed support with resilient longitudinal rails made of a foam material and connected transverse slats made of wood is shown in German Patent Reference DE-A-39 33 816. Loops, extending transversely with respect to the longitudinal direction, are attached to the longitudinal rails, through which the ends of the transverse slats are pushed. The transverse slats have grooves for receiving the loops in order to fix the transverse slats in place with respect to the longitudinal rails. However, the stability achieved by this is not sufficient for transport or under generally strong stresses on the bed support, because the loops can be displaced and therefore removed from the grooves. The grooves also form weak points of the transverse slats and therefore potential breaking points. Moreover, the material of the loops is stressed more in the area of the grooves, since it rubs against the edges of the grooves.

SUMMARY OF THE INVENTION

It is one object of this invention to provide a bed support which removes the above disadvantages, and which furthermore can be cost-effectively produced and simply assembled.

This object is attained by the bed support having the characteristics discussed in this specification and in the claims.

In contrast to the fixation ways taught by the prior art, the longitudinal rails are not fixed in place on each other, nor in the pockets on the transverse slats, but each longitudinal rail is fastened on individual transverse slats separately from the others. Moreover, a stable fixation of the transverse slats and the longitudinal rails in relation to each other, which is not subject to aging, is assured with minimal means by this construction.

A very stable fixation in place is achieved without requiring a covering over the entire width of the bed support. The savings in material are considerable, so that the production costs are lowered.

Since it is possible to select a relatively short fastening strip, the danger of material fatigue, and therefore a reduction of the stability, is eliminated.

The fastening strip extends transversely to the transverse slats, and in a preferred embodiment maximally has the width of a single transverse slat. Thus, it is arranged very discreetly and does not interfere with the appearance. Moreover, no essentially downwardly projecting or hanging elements exist, which could act as dust collectors or which could be snagged, for example when vacuuming.

BRIEF DESCRIPTION OF THE DRAWINGS

Exemplary embodiments of this invention are shown in the attached drawings and will be explained in the following description wherein.

DESCRIPTION OF PREFERRED EMBODIMENTS

Figure 1:
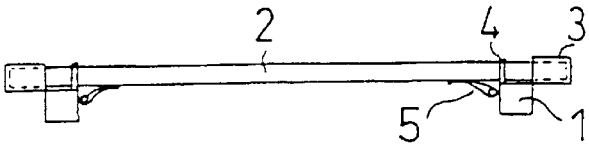
FIG. 1 is a lateral view of a first embodiment of the bed support in accordance with this invention.
Figure 2:
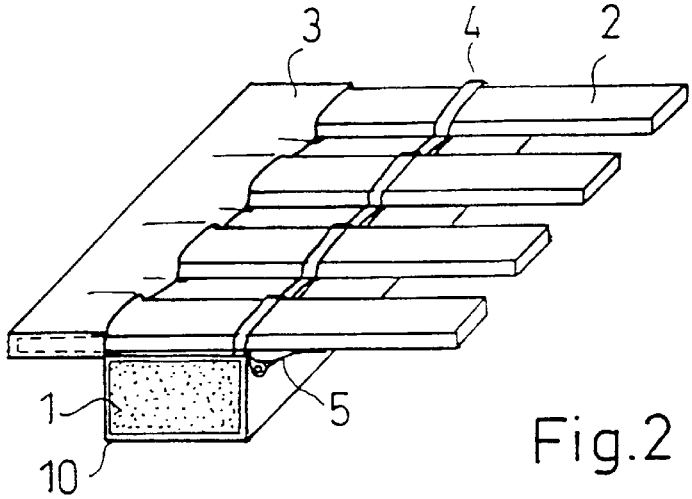
FIG. 2 is a perspective top view of a portion of the bed support in FIG. 1.

A first exemplary embodiment of the bed support in accordance with this invention is shown in FIGS. 1 to 5. As best shown in FIGS. 1 and 2, the bed support comprises two resilient or springy longitudinal rails 1 or spring bodies, distanced from and arranged parallel with respect to each other, and several transverse slats 2, which are arranged in the manner of a grate transversely in respect to the longitudinal rails 1, rest on the latter and connect them with each other. The longitudinal rails 1 are made of an elastomeric material, preferably of latex, and have a textile cover, preferably natural cotton. They can have any arbitrary cross section which, for example, can be rectangular, as shown. However, they can also have a round or oval shape. The transverse slats 2 are preferably made of solid wood, for example ash slats, and generally have a thickness of 4 to 15 mm. The transverse slats 2 are at least approximately flat.

Pockets 3, which are oriented transversely to the longitudinal direction, are arranged on the longitudinal rails 1. In this embodiment, the pockets 3 are sewn on a side of the longitudinal rail 1, so that they form a lateral extension. In general, the pockets 3 are also made of a textile material, in particular of woven pure natural fibers, such as hemp or cotton. The ends of the transverse slats 2 are pushed into the pockets 3 and are held in them, wherein a portion of the transverse slats 2 projecting out of the pockets 3 rests on the longitudinal rails 1. Because the pockets 3 are attached on one side of the longitudinal rails 1, a loop band 4 is fastened on the opposite side of the longitudinal rail 1, which extends in the longitudinal direction and through whose loops the transverse slats 2 are extended.

Figure 3:
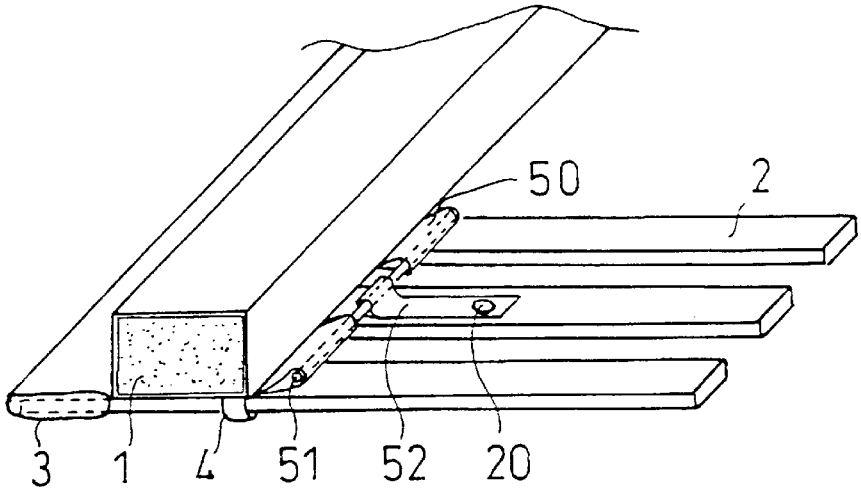
FIG. 3 is a perspective bottom view of a portion of the bed support in FIG. 1.
Figure 5:
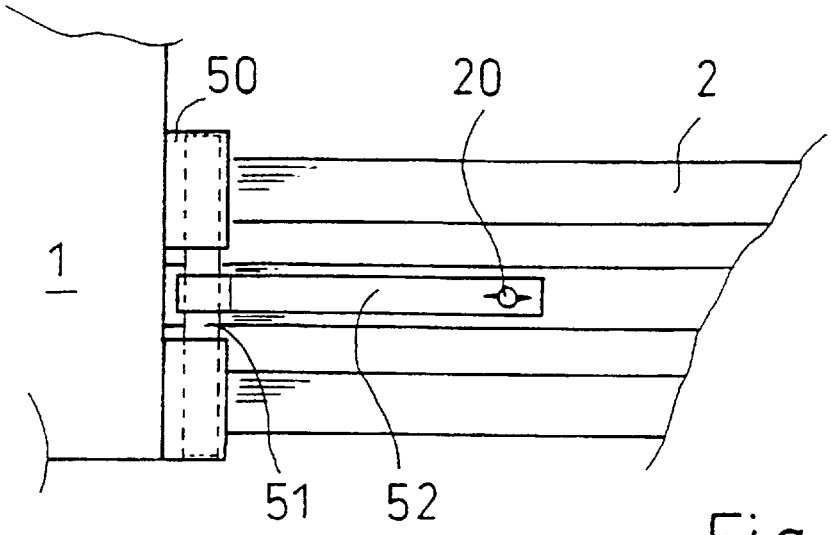
FIG. 5 is a top plan view of the bed support in accordance with FIG. 1.

At least one fastening means 5 is connected with each longitudinal rail 1, which has a connecting means and a fastening strip 52, as shown in FIGS. 3 and 5. The fastening strip 52 is oriented toward the other longitudinal rail 1 and extends in the transverse direction. Preferably the fastening strip 52 is also made of a textile material, for example woven natural fibers. In another embodiment, not shown, the fastening strip 52 is fastened directly to the longitudinal rail 1. However, preferably and as shown, a connecting means is provided, which is effective over a distance of at least three transverse slats 2 and in this way distributes tensile forces acting through the fastening strip 52 over this distance. The connecting means has two fastening loops 50, attached spaced apart from each other to the longitudinal rails 1, which are made of textile strips, for example woven cotton, and of a connecting bolt 51, which is pushed through the fastening loops 50. The fastening strip 52 loops around a center area of the connecting bolt 51 which is not covered by the fastening loops 50. The manufacture and assembly of the fastening means is simplified by this construction. Moreover, the fastening strip 52 can be made narrower, even if the force distribution to the longitudinal rails 1 takes place over a large area. Therefore the width of the fastening strip 52 preferably corresponds maximally to one transverse slat 2. The length is between 8 and 20 cm, preferably approximately 14 cm.

The fastening strip 52 has a button hole, through which a fastening button 20 attached to the transverse slat 2 extends. The fastening strip 52 is fastened in this way on the transverse slat 2, and each longitudinal rail 1 is fixed, separate from the other longitudinal rail, with respect to the transverse slats 2.

Figure 4:
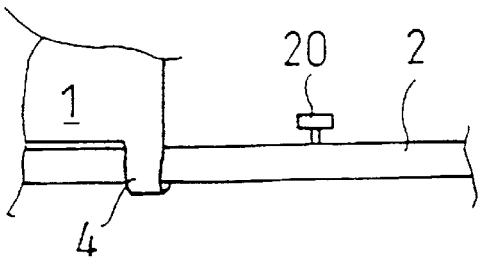
FIG. 4 is a lateral view of a portion of a transverse slat with a fastening button.

As shown in FIG. 4, the fastening button 29 preferably is of a wooden dowel, which is driven into the transverse slat 2 and has a projecting head.

The fastening strip 52 and the fastening button 20 are arranged on the underside of the bed support, i.e. facing away from the surface for lying. Preferably two or more fastening strips 52 with separate connecting means are arranged at a distance from each other on each longitudinal rail 1, wherein each fastening strip 52 is assigned its own fastening button 20. Moreover, an adjoining fastening strip of the oppositely located rail 1 exists for each fastening strip 52, whose associated fastening button 20 is placed on the same transverse slat 2 as the fastening button 20 of the first fastening strip 52.

Figure 6:
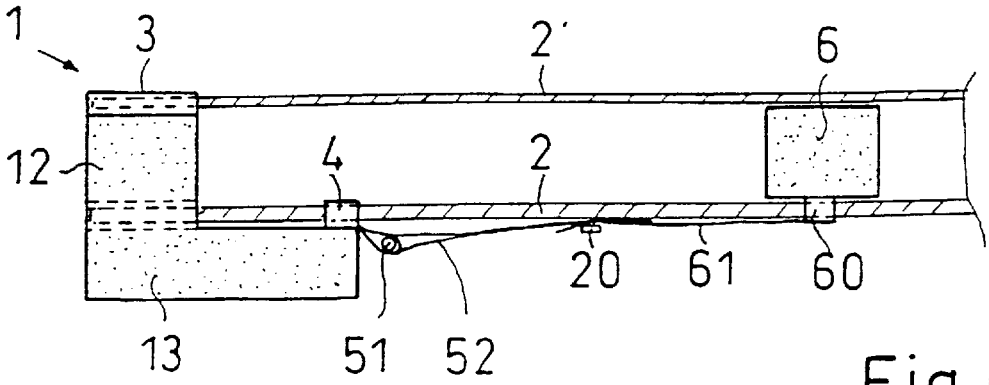
FIG. 6 is a section view taken through a portion of a second embodiment of the bed support in accordance with this invention.

A second embodiment of the bed support of this invention is shown in FIG. 6. Here, two slat grates are provided, which are formed by a set of upper transverse slats 2' and a set of lower transverse slats 2. The upper transverse slats 2' are generally embodied to be thinner and therefore more flexible than the lower transverse slats 2. Typical thickness of the upper transverse slats 2' is 4 to 8 mm, and of the lower transverse slats is 10 to 12 mm.

Figure 7:
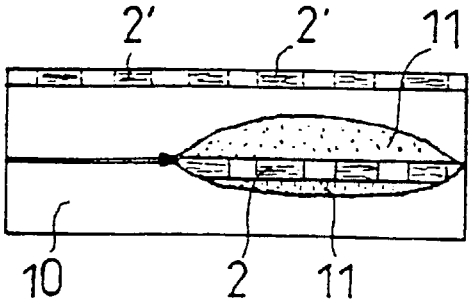
FIG. 7 is a plan view of a portion of a longitudinal side of the bed support in accordance with FIG. 6.

Again, two resilient longitudinal rails 1 are provided, which connect the transverse slats 2, 2' with each other. Here, the longitudinal rails 1 have an L-shaped cross section and in this way form a right angle. The pockets 3 for receiving the ends of the upper transverse slats 2' are attached to a front face of short legs 12 and rest on the front face. Thus, the upper transverse slats 2' rest on the front face of the short leg 12. The lower transverse slats 2 rest on the inside of the long leg 13 and extend through the longitudinal rails 1. The longitudinal rail 1 with a partially opened zipper of the textile cover 10 is shown in FIG. 7. As shown in FIG. 7, the longitudinal rail 1 has two solid body cores 11, which are arranged on top of each other and are enclosed in the textile cover 10 and between which the ends of the lower transverse slat 2 are pushed. Moreover, a loop band 4 is fastened on the inside of the long leg 13, through which the lower transverse slats 2 extend.

The assembly and changing of the lower transverse slats 2' is made easier by means of this construction, since they can be pulled out of the longitudinal rail 1 without bending.

The fastening strip 52 is fastened by the connecting means on the front face of the long leg 13. The fastening buttons 20 are attached to an underside of at least one lower transverse slat 2.

Depending on the width of the bed or the desired firmness of the bed support, at least one resilient spacing or support rail 6, extending in the longitudinal direction and preferably having a rectangular or oval cross section, and which essentially has the same structure as the longitudinal rails 1, but does not have pockets 3, is provided between the lower and upper transverse slats 2, 2'. For fastening on the transverse slats 2, in this case the lower transverse slats 2, the support rail has a loop band 60, which extends at least approximately over the entire length, and through which loops the lower transverse slats 2 pass.

So that the at least one support rail 6 is not displaced from its position and therefore does not negatively affect the comfortable rest, it is fastened in the embodiment shown here on the lower transverse slats 2 by means of a fastening strip 61 having at least one button hole. These second fastening strips 61 comprise a textile material and are fastened on the loop band 60, preferably in a woven fashion. As shown, the second fastening strips 61 are suspended from the fastening buttons 20 used for fixing the longitudinal rails 1 in place, or from separate fastening buttons.

If one support rail 6 is provided, it is fastened on both ends on the fastening buttons 20 via the second fastening strips 61. If several, in particular two support rails 6 are provided, in one embodiment only the outside support rails 6 are connected on their side facing the longitudinal rails 1 with the closest fastening button via the second fastening strip 61. To prevent displacement in the other direction, the support rails 6 are connected with each other by means of fixedly arranged or releasable strips.

What is claimed is:

1. In a bed support having two resilient longitudinal rails (1) arranged spaced apart and parallel with respect to each other, and a plurality of transverse slats (2) arranged in a grate-like manner, wherein a plurality of pockets (3) which are oriented transversely with respect to a longitudinal direction and into which are positioned ends of the transverse slats (2) are arranged on the longitudinal rails (1), and wherein at least one fastening means (5) for fixing the transverse slats (2) and the longitudinal rails (1) in place in relation to each other is connected with each of the longitudinal rails (1), the improvement comprising:

at least one fastening strip (52) attached on each of the longitudinal rails (1) transversely with respect to the longitudinal direction and oriented toward the other one of the longitudinal rails (1), and a fastening button (20) on a nearest of the transverse slats (2) fastening the fastening strip (52) on the transverse slat (2).

2. In the bed support in accordance with claim 1, further comprising connecting means for connecting the fastening strip (52) to the longitudinal rail (1) which are effective over a distance of at least three of the transverse slats (2).

3. In the bed support in accordance with claim 2, wherein the connecting means comprise two fastening loops (50) spaced apart in the longitudinal direction and attached to the longitudinal rails (1), a connecting bolt (51) passing through the fastening loops (50), and the fastening strip (52) attached to a center area of the connecting bolt (51) between the fastening loops (50).

4. In the bed support in accordance with claim 1, wherein the two fastening strips (52) are arranged spaced apart from each other and are provided on each of the longitudinal rails (1).

5. In the bed support in accordance with claim 1, wherein one of the fastening strip (52) and the fastening strips of one of the longitudinal rails (1) is arranged opposite one of the fastening strips of the second longitudinal rail, and the associated fastening buttons (20) are attached to the same transverse slat (2).

6. In the bed support in accordance with claim 1, wherein a first width of the fastening strip (52) maximally corresponds to a second width of the transverse slat (2).

7. In the bed support in accordance with claim 1, wherein the fastening strip (52) is arranged on an underside of the bed support.

8. In the bed support in accordance with claim 1, wherein the pockets (3) form a lateral extension of the longitudinal rails (1) so that the transverse slats (2) projecting out of the pockets (3) rest on the longitudinal rails (1).

9. In the bed support in accordance with claim 1, wherein upper and lower slats of the transverse slats (2, 2') are respectively arranged in a grate-like manner between the longitudinal rails (1), the longitudinal rails (1) each has an L-shaped cross section, the upper slats (2') are supported on front faces of a short leg (12) of the longitudinal rails (1), and the lower slats (2) rest on an inside of a long leg (13), wherein a loop band (4) extending in the longitudinal direction is arranged at the end of the long leg (13) for receiving the lower transverse slats (2), and the fastening buttons (20) for fastening the fastening strips (52) are arranged on the lower slats (2).

10. In the bed support in accordance with claim 9, wherein at least one resilient support rail (6) extending in the longitudinal direction is arranged between the lower slats (2) and the upper slats (2'), which has a loop band (60) for passing transverse slats (2) through, and the at least one support rail (2) is fastened on the fastening buttons (20) of the lower transverse slats (2) via second fastening strips (61).

* * * * *